US007518509B2

(12) United States Patent
Pieper

(10) Patent No.: US 7,518,509 B2
(45) Date of Patent: Apr. 14, 2009

(54) METHOD AND DEVICE FOR SECURING OBJECTS

(75) Inventor: Norbert Pieper, Koblenz (DE)

(73) Assignee: Deutsche Post AG, Bonn (DE)

( * ) Notice: Subject to any disclaimer, the term of this patent is extended or adjusted under 35 U.S.C. 154(b) by 586 days.

(21) Appl. No.: 11/293,386

(22) Filed: Dec. 2, 2005

(65) Prior Publication Data

US 2006/0146133 A1 Jul. 6, 2006

Related U.S. Application Data

(63) Continuation of application No. PCT/DE2004/001111, filed on May 27, 2004.

(30) Foreign Application Priority Data

Jun. 5, 2003 (DE) ..... 103 25 909

(51) Int. Cl.
*G08B 13/00* (2006.01)

(52) U.S. Cl. ..... 340/568.1; 340/572.1; 340/539.23; 340/539.32; 340/5.92; 340/10.1; 235/385

(58) Field of Classification Search ..... 340/568.1, 340/572.1, 572.2, 572.3, 539.13, 539.23, 340/539.32, 5.2, 5.92, 10.1; 235/385; 348/156
See application file for complete search history.

(56) References Cited

U.S. PATENT DOCUMENTS

| | | | | |
|---|---|---|---|---|
| 5,745,036 | A | 4/1998 | Clare | 340/572 |
| 6,104,285 | A | 8/2000 | Stobbe | 340/505 |
| 6,195,006 | B1 | 2/2001 | Bowers et al. | 340/572.1 |
| 6,509,829 | B1 * | 1/2003 | Tuttle | 340/10.1 |
| 6,989,749 | B2 * | 1/2006 | Mohr | 340/572.1 |
| 7,123,126 | B2 * | 10/2006 | Tanaka et al. | 340/5.2 |
| 7,123,149 | B2 * | 10/2006 | Nowak et al. | 340/572.1 |
| 7,286,158 | B1 * | 10/2007 | Griebenow | 348/156 |

FOREIGN PATENT DOCUMENTS

| | | |
|---|---|---|
| DE | 38 07 936 A1 | 9/1989 |
| DE | 197 45 953 A1 | 4/1999 |
| DE | 200 11 952 U1 | 11/2001 |

(Continued)

OTHER PUBLICATIONS

International Search Report in PCT/DE2004/001111 dated Nov. 2, 2004.

(Continued)

*Primary Examiner*—Davetta W Goins
(74) *Attorney, Agent, or Firm*—Marshall, Gerstein & Borun LLP

(57) ABSTRACT

A method and a device for securing objects that are present in protected spatial areas, whereby the objects to be secured are provided with an identifier or linked with an identifier and said identifier is detected by a receiving unit when the object to be secured is displaced. For this purpose, the receiving unit detects the presence of the identifier and electronic data for proving the presence of the identifier are stored. The electronic data are adapted to allow an unambiguous assignment of the signal detected by the receiving unit to the identifier. Data are detected independently of the detection of the identifier that allow an identification of a person carrying an object to be secured.

23 Claims, 1 Drawing Sheet

FOREIGN PATENT DOCUMENTS

| | | | |
|---|---|---|---|
| DE | 100 33 557 | A1 | 1/2002 |
| EP | 762 535 | B1 | 3/1997 |
| EP | 1 040 447 | B1 | 10/2000 |
| WO | WO 98/38605 | A2 | 9/1998 |
| WO | WO 98/38605 | A3 | 9/1998 |
| WO | WO 01/82254 | A1 | 11/2001 |

OTHER PUBLICATIONS

International Preliminary Search Report in PCT/DE2004/001111 dated May 23, 2005.

* cited by examiner

METHOD AND DEVICE FOR SECURING OBJECTS

CROSS-REFERENCE TO RELATED APPLICATION

This is a continuation of International Application No. PCT/DE2004/001111 filed May 27, 2004, the entire disclosure which is incorporated herein by reference.

BACKGROUND OF THE INVENTION

1. Field of the Invention

The invention relates to a device for securing objects, preferably inside closed buildings, especially for securing objects that belong to the inventory of an office.

The invention also relates to a device for detecting and storing signals that are emitted by a transmitter located on the object and that have a unique encoding for each object.

2. Related Technology

A device for securing issued tools or equipment is known from DE 200 11 952 U1, which disclosed a transponder using 128-bit information and containing data about the type of tool wherein, a consecutive serial number and information about the normal workplace is attached to each item of a set of tools. In this context, the normal workplace can be either a toolbox or a specific storage place, as long as this workplace has a stationary receiver for exchanging signals with the transponders that are attached to the tools. The receiver, in turn, is connected to a computer that allows the evaluation of the signals received by the receiver and emitted by the transponders attached in the toolbox or on the tools located at the workplace. Thus, at any point in time during the internal work procedures, the current status of the tools located in a specific toolbox or workplace can be displayed. In another embodiment of the device, a dedicated transponder is associated with each worker by means of which the toolbox belonging to the worker can be opened.

DE 197 45 953 A1 describes a device for automatically detecting and identifying a merchandise security label by means of a base station. The merchandise security label attached to the product to be secured comprises a transponder having an NF transmitting-receiving unit of its own that is used for communication with the base station. If, for example, a transponder enters the range of action of the electromagnetic field generated by the base unit, the base station transmits a control signal that is received by the transponder and that, in turn, causes the transponder to emit a response signal. This response signal is further processed by the base station and, in case of a successful checking, triggers a transmitting pulse at the base station that, in turn, is received by the transponder. This transmitting-receiving sequence can be used to integrate previously specified checking criteria which, if not observed, lead to the triggering of an alarm. In a preferred embodiment, the alarm signals of several transponders located in the range of action of the electromagnetic field of the base station are synchronized so as to ensure that the base station reliably recognizes a received alarm signal.

Another electronic anti-theft device is known from DE 38 07 936 A1. This publication discloses an especially preferred construction of a passive transponder that is combined with a barcode and whose dimensions are extremely small, whose receiver is coordinated with the double transmit frequency and that is thus insensitive to reflections of the fundamental wave of the transmitter. The stationary transmitting means is implemented either in the form of conventional transmitting-receiving means from the realm of high-frequency technology or in the form of array antennas employing stripline technology so that when the product identified by the transponder passes through the electromagnetic field generated by the stationary transmitting-receiving unit, the passive transponder is excited to emit radiation. The radiation emitted by the passive transponder can then be used to trigger an alarm signal.

A device for finding files is known from DE 100 33 557 A1. Here, signal transmitters in the form of transponders are attached to the files and the encoded signals that are transmitted by the transponders are detected by transmitting-receiving means that are preferably mounted on the ceilings and subsequently made available to a database for internal administration purposes. A central computer makes it possible to process the existing data records by means of an adapted administration routine in such a way that the current location of any given file from the stock of files can be ascertained at any time.

Various devices for the set-up and further refinement of transponders (passive or active functional structure) can be found, for example, in European patent EP 1 040 447 B1 or in European patent EP 0 762 535 B1.

The current state of the art in the realm of securing objects essentially describes devices for the explicit recognition of signal transmitters attached to objects as soon as these are located within a specified area.

U.S. Pat. No. 6,195,006 describes an inventory system with which articles that are loaned out to patrons are each provided with a transponder. At an article check-out counter, the signals emitted by the transponders as well as identification information of the patrons to whom the articles are checked out are then detected and transmitted to a database. The articles are returned at one or more return areas where the transponder signals of the returned articles are detected and transmitted to the database.

U.S. Pat. No. 5,745,036 describes an article security system for a store with which articles are provided with transponders that emit signals with identification codes of the articles. The system comprises several cash registers and a computer that stores identification codes of articles that have been paid for. In the store exit area, the identification codes are detected together with the date and time and, likewise indicating the date and time, video images are taken of the person transporting the articles. In order to recognize theft, the identification codes detected at the cash registers are regularly compared to the codes detected at the store exit and the corresponding video data is evaluated.

GENERAL DESCRIPTION OF THE INVENTION

The invention is based on the objective of refining a method of the generic type in such a way that it is possible to ascertain whether individual objects have been removed without permission from a specified area, especially from a closed building or from an area of a building, whereby the method should be carried out in such a way that the authorized removal of objects from the secure area can be carried out without any hindrance.

According to the invention, this objective is achieved in that a method for securing objects is carried out in such a way that the receiving unit detects the presence of the identification means, whereby the objects to be secured are equipped with an identification means or connected to the identification means, the identification means is detected by a receiving unit during the transport of the object to be secured and electronic data that verifies the presence of the identification means is stored, whereby the electronic data is configured in such a way that it allows an unambiguous association of the signal detected by the receiving unit with the identification means, and that, independent of the detection of the identification means, information is detected that allows the identification of a person transporting an object that is to be secured.

In this manner, it is possible that numerous objects can be transported out of a building without the need for a change in an identification means that secures these objects and without a hindrance of the persons who are authorized to transport these objects out of the area that is to be secured.

A first preferred embodiment of the invention is characterized in that the person transporting the object to be secured is detected in that the authorization ID badge of the person is checked in an automated verification step.

In this manner, it is possible to ascertain in an especially simple and reliable manner which person has taken an object to be secured out of the secure area.

Furthermore, it is advantageous to carry out the method in such a way that a video recording is made of the person transporting the object to be secured.

In this manner, it is likewise possible to obtain a reliable identification of persons who have taken objects to be secured out of the secure area.

An especially preferred embodiment of the invention is characterized in that the identification data of the objects to be secured and the identification data of the persons transporting the objects to be secured are detected separately from each other, whereby the identification data of the objects and/or the identification data of the persons are secured in a data area that is specially protected against external access.

This embodiment of the invention is especially well-suited for use in applications in which numerous persons work in the secure area whose personal privacy rights call for special protection.

In particular, this embodiment of the invention makes it possible to prevent authorized transport procedures of objects to be secured from being related in any way to the persons transporting said objects.

For example, in this manner, it is possible that only under special prerequisites is stored identification data of persons accessed and/or is the identification data of the persons linked to identification data of objects to be secured.

An especially advantageous embodiment of the invention makes it possible to ascertain persons who, without authorization, have transported objects out of the area that is to be secured, but to prevent access to identification data of the persons who have been authorized to take objects out of the area that is to be secured.

In order to prevent access to personal data that is to be protected, it is especially advantageous to ascertain which of the objects taken out of the secure area have been brought back.

Furthermore, it is advantageous to carry out the method in such a way that electronic data about the removal of an object from the secure area is deleted once the object to be secured has been brought back into the secure area.

This has the advantage of reducing the risk of misuse of stored data and also of reducing the storage space needed for storing the data.

Moreover, it is advantageous to check whether objects have been brought back into the area that is to be secured within a specifiable period of time and to start an automated processing routine in case one of the objects to be secured has not been brought back into the secure area within the specifiable period of time.

In this manner, the removal of secured objects can be detected iri an automated way without this causing a hindrance of authorized transport procedures of the secured objects.

Furthermore, it is advantageous for the automated processing routine to comprise the generation of a warning.

Another preferred embodiment of the invention is characterized in that access to the secure data area can only be gained after the input of at least one authorization code.

Moreover, it is advantageous for access to a specially secure data area to only be gained after the independent input of two different authorization codes.

In another advantageous embodiment of the invention, a method for securing objects inside protected areas with which the objects to be secured have a transmitter, the transmitter provides an encoded signal in the presence of a receiving field, the encoded signal is detected by a receiving unit and subsequently converted into electronically processable encoded data is carried out in such a way that the receiving unit amplifies the electronic data, that the electronic data is transmitted via an interface to a first data transmission line, that the encoded data is stored in a data storage means, that a recording unit for video data is activated when the encoded data is received, and that the video data is stored.

Another subject matter of the invention is a device for securing objects inside closed buildings, whereby the object to be secured has a transmitter that, in the presence of a receiving field, supplies an encoded signal, whereby the encoded signal is detected by a receiving unit and subsequently converted into electronically processable encoded data.

This device is characterized in that the device comprises a receiving unit, whereby the receiving unit amplifies the electronic data, in that the device has an interface, whereby the interface allows a connection between the receiving unit and the first data transmission line, in that the interface is configured in such a way that the encoded data can be transmitted to a data transmission network, and in that the data transmission network connects the interface to a data archive for purposes of processing and storing data, and consequently the encoded data can be stored in the archive, whereby the encoded data triggers a switching operation, activates a recording unit that is located in the immediate vicinity of the receiving field and that serves to process video data, whereby the video data taped by the recording unit is transmitted to the archive by means of a second data transmission line and then stored in the archive, whereby, after the expiration of a time interval during which no other receiving event occurred as a result of a signal of said encoding, a reading out of the stored data of the object previously belonging to the encoding as well as of the video data is triggered.

In an especially preferred embodiment of the invention, the receiving unit for receiving and amplifying the encoded signal can process at least one of the following types of signal: electromagnetic waves, acoustic waves or infrared radiation.

Furthermore, it is advantageous for the receiving unit to allow the transmission of signals.

It is also advantageous for the first and the second data transmission lines to each be a means for the loss-free transfer of data.

In an especially preferred embodiment of the invention, the first data transmission line is an RS 232 cable.

Moreover, it is advantageous for the second data transmission line to be a coaxial cable.

In an especially preferred embodiment of the invention, the interface is a gateway.

Furthermore, it is advantageous for the receiver as well as the interface to form a unit having a shared power supply.

In an especially preferred embodiment of the invention, the data transmission network consists of at least one RS 485 bus and at least one data transmission line.

Furthermore, it is advantageous for the data transmission line to be an RS 485 cable.

In an especially preferred embodiment of the invention, at least one data archive is connected to the data transmission network.

Furthermore, it is advantageous for the data archive to have at least one FBAS (BNC) video input and, at the maximum, four FBAS (BNC) video inputs.

In an especially preferred embodiment of the invention, the data archive is connected to a local network, as a result of which data from the archive is supplied for evaluation purposes to different places within the network.

Furthermore, it is advantageous for the local network to be an Ethernet.

In an especially preferred embodiment of the invention, the data is evaluated by a computer having a means for processing Internet standards.

Furthermore, it is advantageous for the data archive to be a digital data archive.

In an especially preferred embodiment of the invention, the digital data archive uses a hard disk in order to store the data.

Furthermore, it is advantageous for the data archive to be an analog data archive.

In an especially preferred embodiment of the invention, the transmitter for supplying the encoded signals supplies at least one of the following types of signal: electromagnetic waves, acoustic waves or infrared radiation.

Furthermore, it is advantageous for the transmitter for supplying the encoded signals to be a transponder.

In an especially preferred embodiment of the invention, the transmitter is a semi-active transponder.

Furthermore, it is advantageous for the objects to preferably belong to an office inventory such as fax machines, cell phones, laser beamers, data media or files.

The presence of the signal transmitter in the detection field or in the transmitting-receiving field, which is preferably an electromagnetic field, is used either to generate an alarm signal or else to register and store encoded data that is contained in the signal transmitter. Numerous possible modalities of use can be implemented. In the case of devices or methods that make use of the generation of an encoded signal by means of a signal transmitter attached to the object in order to store the received encoded data separately in a memory, whereby the latter is connected to a data processing routine, as a rule, the data processing routine is utilized for the following sequence: once the signal has been detected, a conclusion is drawn on the basis of the signal encoding as to which object, optionally at which time, interacted with the detection field, whereby the location of the detection field makes an indirect conclusion about the current location of the object.

It is true that the invention can fundamentally be combined with familiar merchandise security methods and that familiar merchandise security systems can fundamentally be modified for the execution of the invention, but the invention allows a much more comprehensive mode of functioning.

In particular, the invention makes it possible to operate a merchandise security system in which objects to be secured can be taken out of a secure area without there being a need to deactivate or remove security labels for this purpose.

In particular, the invention makes it possible to implement a merchandise security system with which the unauthorized removal of objects to be secured can effectively be avoided without the need for a deactivation of security labels.

For purposes of a more comprehensive illustration of the achieved functionality, the following example is provided: the shared use, for example, of fax machines, cell phones, portable computers, laser beamers or data media within a building complex, preferably an office building, calls for the configuration of a device that fundamentally allows the employees in the building complex to use and—if necessary—to relocate the above-mentioned objects, but preferably so that, at any time when an object is taken out of an area within the building or out of the building itself, a procedure is initiated that allows a link to be made between the person who has taken the object and the object itself.

This link makes it possible to draw conclusions about the manner, about how and about who has taken the object in question through the detection area. On the other hand, it is not always possible to readily identify the carrier, or rather the person, who has possession of the object to be secured in such a way that an unambiguous link can be made between the object and the carrier of the article in question. One possibility would be to provide all of the people who have access to the objects with their own additional signal transmitter that would then forward person-specific data to a receiver as soon as the signal transmitter enters the detection field.

The invention is especially suited for use in closed buildings, for example, office buildings, since a means for person-specific identification, for example, a company ID badge, could be equipped with an additional transponder whose signals emitted in a detection field would allow a link with the carrier of the card. A conceivable device could be configured in such a way that, as a result of a coincident arrival of an encoded signal from the transponder attached to an object and of another encoded signal from the additional transponder located on the company ID badge, a storage procedure that records all encoded data is triggered when the detection area is entered. The guarantee of success of such an object security device, however, depends on the wearing of the person-specific identification means. In addition, the wearing of an outside identification means could result in incorrect links.

Another aspect of an object security system according to the invention lies in its compliance with data protection requirements when objects are used simultaneously by numerous authorized users, whereby the objects should be registered at all times in a system that ascertains any unauthorized removal of an object and that allows a linking to the person removing the object while, at the same time, complying with data protection requirements.

Therefore, the invention provides an extremely effective, data-protected object security system that is especially suited for use inside closed buildings.

BRIEF DESCRIPTION OF THE DRAWINGS

Additional advantages, special features and advantageous embodiments of the invention can be gleaned from the following description of a preferred embodiment, making reference to the drawings.

DETAILED DESCRIPTION

Figure 1:
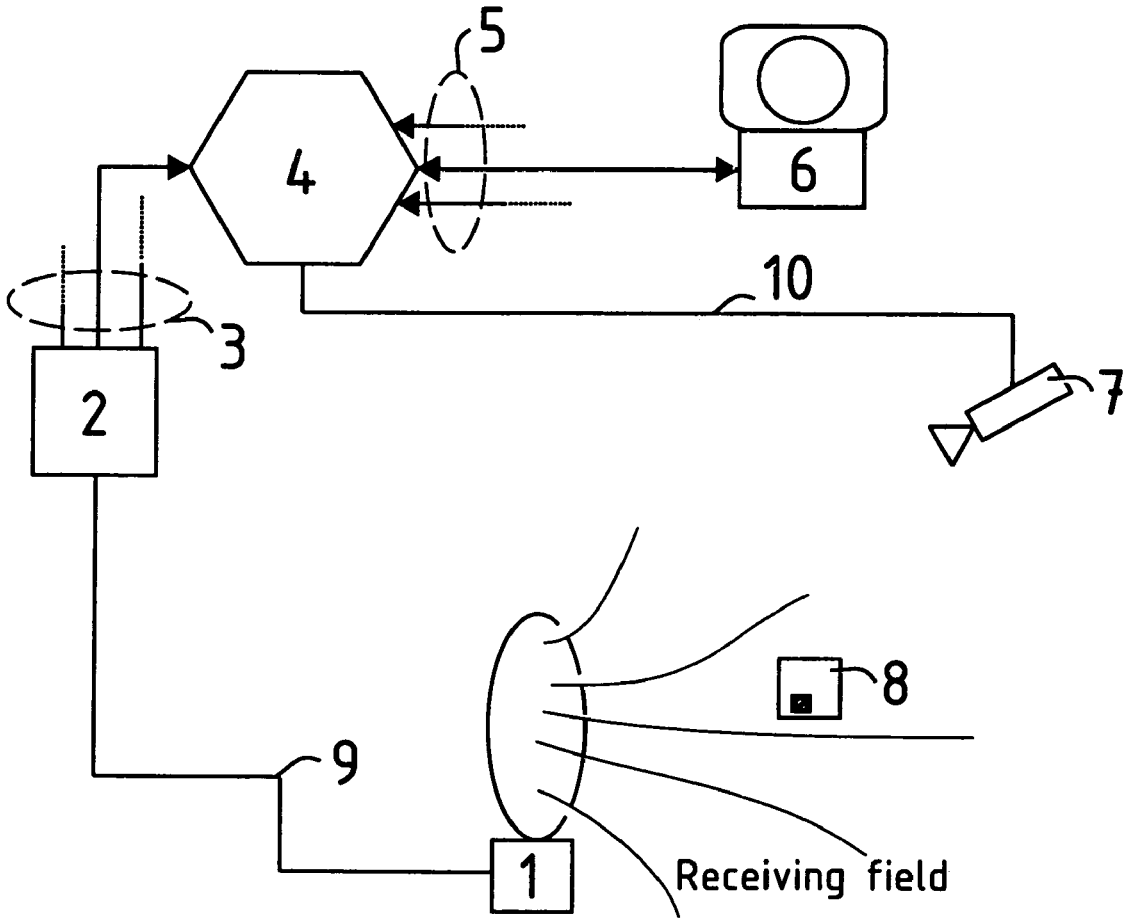
FIG. 1 shows a schematic representation of the device according to the invention.

Referring now to the FIGURE, the device according to the invention includes a computer 6 for processing recorded video data as well as the encoded data of the transmitter 8 located on an object to be secured.

The term "computer" here is not to be construed in any restrictive manner whatsoever. This can be any unit that is capable of carrying out computations, for example, a work station, a personal computer, a microcomputer or circuitry that is suited for carrying out computations and/or comparisons.

The term archive refers especially to a superordinated computer-controlled memory that systematically compiles and manages data and information. The content of this archive is queried and output in a structured manner using at least one suitable means for data processing. The means for data processing can be based on a logical problem-oriented structure of the data for storing on a mass storage device.

A few familiar symbol-oriented structures are known by their abbreviations BASIC, PASCAL, C(++), COBOL or Java and they serve for the development of complex systems. Moreover, structures based on the Internet are also known. Here, the Internet is to be understood as an open mass network of "gateway" computers that are structurally connected by a uniform Internet protocol-address set-up as well as physically via data lines.

As employed in the device according to the invention, a computer-controlled network is described by a complex system of data-processing means and by the data lines 9, 10 that connect the data-processing means, whereby a network can differ by a certain configuration from another network.

Thus, via a network, several data-processing means that are connected to each other, central memories and data, printers, scanners, etc. can all be shared. Among others, the following networks are known: (1) several computers that are connected to each other in a spatially limited area: "Local Area Network (LAN)". (2) Several computers that are connected to each other over a wide area by means of telephone lines: "Wide Area Network (WAN)". (3) Network spanning the world: "Global Area Network (GAN)". (4) Homogeneous network: network with similar computers and software. (5) Heterogeneous network: network with different types of computers and software.

A LAN 5 preferably refers to a data transmission network that, in a spatially limited manner, allows communication via a server and thus allows the exchange of information. Conventionally, the terms "Client" and "Server" are used for the computers that are located in a network, namely, in such a way that a server is available for several clients. The server provides the clients, for example, with memory, computing time or files. A few typical examples of a LAN are the networked computers of a university or of a company. The connected stations can share the data and the management of the peripherals (e.g. printers, modems, etc.). A typical LAN is the "Ethernet", which works according to the bus principle. An Ethernet currently functions with normal and coaxial cables at a speed of up to 10 Mbps (mega bits per second). The newer "Fast Ethernet" allows transmission speeds of up to 100 Mbps. Moreover, a LAN is a network that can be connected to other LANs; a plurality of virtual LANs forms a VLAN.

Typical performance features of the Internet are, among others: (1) "Telnet" for loading programs onto other computers, (2) "FTP (File Transfer Protocol)" for the transfer of files to other computers, (3) "World Wide Web (WWW)" or (4) "Gopher" for the topic-specific access to information systems all over the world. The Internet, as a worldwide network GAN, is linked via TCP/IP (TCP/IP stands for Transmission Control Protocol/Internet Protocol) and it is a set of protocols. Since they both complement each other (TCP is a control protocol for IP), they are often mentioned together.

A typical structure based on the Internet is the "Hypertext Markup Language (HTML)", which determines the exchange of hypertext documents in the WWW and which is based on TCP/IP. Hypertexts here are text documents, depicted on a graphic interface with the possibility of triggering actions by activating specially marked words or symbols. Another structure based on the Internet is the "Extensible Markup Language (XML)", which constitutes a refinement of HTML. XML allows the greatly simplified creation of complex hypertext documents in the data traffic of the WWW. XML is to be extensively used particularly in the "e-commerce" area of the Internet.

Interfaces 2 are used in an especially advantageous embodiment of the device according to the invention. Interfaces constitute the connection site between software or hardware systems, whereby software interfaces are methods for translating data from one program into another program, e.g. by means of a conversion of the data. Moreover, the possibility exists to use hardware interfaces. An especially advantageous embodiment of a hardware interface connects electronic and encoded data to a data transmission network 3.

Another advantageous embodiment of a hardware interface 2 is a gateway computer that will be referred to below as gateway. A gateway can be, for example, a node computer between networks that connects compatible and incompatible networks to each other, thus making it possible to connect homogeneous and heterogeneous networks to each other. A gateway makes it possible, for example, to connect networks consisting of computers to a mainframe computer even though these systems do not use the same rule complexes. A gateway forwards all data packages whose network address corresponds to a network address behind the gateway. A routing table addresses an addressee that can convey the data package to the final destination address, conceivably also another gateway. Gateways are used, for example, for two incompatible e-mail systems in order to be able to exchange electronic mail and data with each other, or advantageously for data connection to a data transmission network 3.

Data transmission lines 9, 10 allow either connections between the components within a network or else the are used for connection to a network and can thus constitute a linking component between external units and a network. In this context, the above-mentioned interfaces 2 prove to be extremely advantageous connection sites. Typical components that are to be connected are servers, clients, interfaces or routers. Special preference is given to connections between signal receivers 1, interfaces 2, data archives 4 or video means 7. Currently, a large number of different data transmission lines exist, whereby it has proven to be especially advantageous to use coaxial lines, RS232 lines or RS485 lines.

In general, the RS232 standard describes the serial connection between a data terminal and a data transmission means with its electric and mechanical properties. Moreover, the RS232 interface or the RS232 data transmission line in the device according to the invention has proven to be especially advantageous for serial data transmissions over short distances. The RS232 standard defines a 25-pole SUB-D plug as the standard plug connection. A guideline for the maximum achievable transmission distance by means of an RS232 data transmission line is a distance of 15 to 30 meters.

The RS485 standard (interface or line) is an expansion of the RS232 standard and was designed as a bidirectional bus system for up to 32 subscribers. Physically speaking, the two interfaces differ only negligibly. Since the RS485 standard is meant for large distances, it has proven to be especially advantageous to use RS485 data transmission lines for the connections between an interface 2 and a data archive 4.

A special advantage of the method according to the invention is the unique implementation of the data protection requirements. In this context, data protection refers to the totality of measures for the protection of electronic data during data transmission via data lines 9, 10 as well as for the protection of stored electronic data. The measures extend essentially to the following segments: (1) hardware protection, (2) software protection, (3) data media protection, (4) organization. In the method according to the invention, the data protection is achieved in such a way that the identification data of the objects and/or the identification data of the persons are protected in a data area that is specially secured against external access. Moreover, the electronic data about the removal of an object from the secure area is deleted once the object to be secured has been brought back into the secure area.

Furthermore, for reasons of data protection, it is especially advantageous to check whether objects have been brought back to the area to be secured within a specifiable period of time and that, only if one of the objects to be secured was not brought back within the specifiable period of time, an automatic processing routine is started. Furthermore, access to the secure data area is only gained after the input of at least one authorization code. Moreover, access to a specially secure data area is only gained after the independent input of two different authorization codes.

Fundamentally, different identification means are suited for the unambiguous identification of the objects to be secured.

In order to achieve the most automated possible monitoring method, in which persons who enter or leave the secure area are hindered to the smallest extent possible, it is advantageous to use transponders 8.

Fundamentally, any kind of transponder 8 is suited for use in the various embodiments of the invention.

Passive as well as semi-active and active transponders 8 are suited for use in object security systems according to the invention as well as in methods and devices for implementing object security systems according to the invention.

In order to combine the most reliable possible identification of the objects with a high detection rate, it is especially advantageous to use semi-active transponders 8.

Semi-active transponders 8 are excited by an outgoing signal to, in turn, emit a signal.

Preferably, the semi-active transponder 8 is activated by an electromagnetic signal having a first frequency. The semi-active transponders 8 are excited by the activation to emit an electromagnetic signal having a second frequency.

For example, semi-active transponders 8 are used that are activated by an electromagnetic field having a first frequency of, for example, 125 KHz. Especially advantageous activation frequencies are those in the range from 5 KHz to 200 KHz. Moreover, semi-active transponders 8 are used that are activated by first frequencies in the MHz range.

In this manner, activation distances in the order of magnitude of several meters, preferably in the order of magnitude of one meter to 10 meters, can be achieved.

Through the activation with the electromagnetic field having the first frequency, the semi-active transponders 8 are made, in turn, to emit a signal. Preferably, the electromagnetic signal from the transponder 8 is transmitted in a different frequency range than the electromagnetic fields used for the activation of the semi-active transponders 8.

In an especially preferred embodiment, the semi-active transponders 8 emit in a frequency range of several 100 MHz, for example, in the range of a radio frequency of 433 MHz.

In particular, the signal emitted by the transponders 8 contains the applicable transponder number so that, in this manner, the transponder 8 serves as an identification means for the objects to be secured.

The semi-active transponders 8 preferably each contain their own power source, for example, a battery.

The range of the signal emitted by the transponders 8 is preferably selected to be sufficiently large to allow a reliable detection of the transponders 8. It is preferably several meters, preferably about two meters to 50 meters. Transmission ranges in the order of magnitude of 20 meters to 30 meters are especially advantageous since here, a reliable detection of all of the objects taken from the area to be secured can be combined with a greater distance from the detector and with the avoidance of an erroneous detection of objects that have not been taken out of the area to be secured.

LIST OF REFERENCE NUMERALS (1) receiving unit
(2) interface
(3) data transmission network
(4) data archive
(5) local network
(6) computer
(7) recording unit
(8) transmitter
(9) first data transmission line
(10) second data transmission line

The invention claimed is:

1. A device for securing objects inside closed buildings, whereby the object to be secured has a transmitter that, in the presence of a receiving field, supplies an encoded signal, whereby the encoded signal is detected by a receiving unit and subsequently converted into electronically processable encoded data, the device comprising:

a receiving unit, whereby the receiving unit amplifies the electronic data, and, an interface, whereby the interface is connected to the receiving unit by a first data transmission line, the interface being configured in such a way that the encoded data can be transmitted to a data transmission network, and whereby the data transmission network connects the interface to a data archive for purposes of processing and storing data, and whereby the data archive is configured in such a way that consequently the encoded data can be stored in the archive, wherein the encoded data triggers a switching operation that activates a recording unit that is located in the immediate vicinity of the receiving field and that serves to process video data, whereby the video data taped by the recording unit is transmitted to the archive by means of a second data transmission line and then stored in the archive, whereby, after the expiration of a time interval during which no other receiving event occurs as a result of a signal of said encoding, the stored data of the object previously belonging to the encoded data as well as the video data is read by a computer.

2. The device according to claim 1, wherein it is ascertained which of the objects taken out of the secure area have been brought back to the secure area.

3. The device according to claim 1, wherein the receiving unit for receiving and amplifying the encoded signal can process at least one type of signal selected from the group consisting of electromagnetic waves, acoustic waves, and infrared radiation.

4. The device according to claim 1, wherein the receiving unit allows the transmission of signals.

5. The device according to claim 1, wherein the first and the second data transmission lines are each capable of loss-free transfer of data.

6. The device according to claim 1, wherein the first data transmission line is an RS 232 cable.

7. The device according to claim 1, wherein the second data transmission line is a coaxial cable.

8. The device according to claim 1, wherein the interface is a gateway.

9. The device according to claim 1, wherein the receiver as well as the interface form a unit having a shared power supply.

10. The device according to claim 1, wherein the data transmission network comprises at least one RS 485 bus and at least one data transmission line.

11. The device according to claim 10, wherein the data transmission line is an RS 485 cable.

12. The device according to claim 1, wherein at least one data archive is connected to the data transmission network.

13. The device according to claim 12, wherein the data archive has at least one FBAS (BNC) video input and, at the maximum, four FBAS (BNC) video inputs.

14. The device according to claim 12, wherein the data archive is connected to a local network, as a result of which data from the archive is supplied for evaluation purposes to different places within the network.

15. The device according to claim 14, wherein the local network is an Ethernet.

16. The device according to claim 14, wherein the data are evaluated by a computer capable of processing Internet standards.

17. The device according to claim 1, wherein the data archive is a digital data archive.

18. The device according to claim 17, wherein the digital data archive comprises a hard disk to store the data.

19. The device according to claim 1, wherein the data archive is an analog data archive.

20. The device according to claim 1, wherein the transmitter for supplying the encoded signals supplies at least one type of signal selected from the group consisting of electromagnetic waves, acoustic waves and infrared radiation.

21. The device according to claim 1, wherein the transmitter for supplying the encoded signals is a transponder.

22. The device according to claim 21, wherein the transmitter is a semi-active transponder.

23. The device according to claim 1, wherein the objects belong to an office inventory.

* * * * *